US009272319B2

(12) United States Patent
Wilhelm

(10) Patent No.: US 9,272,319 B2
(45) Date of Patent: Mar. 1, 2016

(54) MACHINING TOOL FOR MACHINING SHEET METAL

(71) Applicant: TRUMPF Werkzeugmaschinen GmbH + Co. KG, Ditzingen (DE)

(72) Inventor: Markus Wilhelm, Gerlingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 14/383,950

(22) PCT Filed: Mar. 12, 2013

(86) PCT No.: PCT/EP2013/055024

§ 371 (c)(1),
(2) Date: Sep. 9, 2014

(87) PCT Pub. No.: WO2013/135716

PCT Pub. Date: Sep. 19, 2013

(65) Prior Publication Data

US 2015/0052716 A1 Feb. 26, 2015

(30) Foreign Application Priority Data

Mar. 13, 2012 (EP) ..... 12159190

(51) Int. Cl.
*B21D 22/08* (2006.01)
*B44B 5/02* (2006.01)

(52) U.S. Cl.
CPC ..... *B21D 22/08* (2013.01); *B44B 5/026* (2013.01); *Y10T 29/5154* (2015.01)

(58) Field of Classification Search
CPC ..... B21D 22/08; B21D 28/12; B21D 28/125; B21D 28/36; B21D 37/04; B21J 9/02; B21J 13/03; B44B 5/026; B26F 1/14; Y10T 29/5154
See application file for complete search history.

(56) References Cited

U.S. PATENT DOCUMENTS

| | | | | |
|---|---|---|---|---|
| 4,144,736 | A | 3/1979 | Honda | |
| 4,499,938 | A * | 2/1985 | Toti | 72/379.2 |
| 4,506,433 | A | 3/1985 | Gingras | |
| 2008/0314220 | A1 * | 12/2008 | Ferry et al. | 83/684 |

FOREIGN PATENT DOCUMENTS

| | | |
|---|---|---|
| CA | 1322123 | 9/1993 |
| CN | 2626643 Y | 7/2004 |

(Continued)

OTHER PUBLICATIONS

Notification of Transmittal of Copies of Translation of the International Preliminary Report on Patentability for corresponding PCT Application No. PCT/EP2013/055024, mailed Sep. 25, 2014, 7 pages.

(Continued)

*Primary Examiner* — Teresa M Ekiert
(74) *Attorney, Agent, or Firm* — Fish & Richardson P.C.

(57) ABSTRACT

A machining tool, such as a forming, embossing, punching or pinching tool carries at least two tool elements at radial external faces for processing sheet metal. The tool elements are fixed to a tool body, either as separate pieces or integrated therein, and the tool body is rotatably supported in a receptacle. The tool body is rotatable about a rotation axis which is not perpendicular to the sheet metal during processing.

17 Claims, 12 Drawing Sheets

(56) References Cited

FOREIGN PATENT DOCUMENTS

| | | | |
|---|---|---|---|
| CN | 201609730 | U | 10/2010 |
| DE | 2648447 | A1 | 4/1978 |
| DE | 2648477 | A1 | 4/1978 |
| EP | 0285597 | A2 | 10/1988 |
| FR | 2847836 | A1 | 6/2004 |
| GB | 2130132 | A | 5/1984 |
| WO | WO8300822 | A2 | 3/1983 |

OTHER PUBLICATIONS

International Search Report from corresponding PCT Application No. PCT/EP2013/055024, mailed May 28, 2013, 7 pages.

* cited by examiner

MACHINING TOOL FOR MACHINING SHEET METAL

TECHNICAL FIELD

The invention relates to a machining tool for machining sheet metal, in particular, a machining tool for a punching machine with which forming operations of sheet metals can flexibly be executed.

BACKGROUND

Machining tools for forming sheet metals, in particular for producing ribbings, gills, pinching contours and embossing, comprising a rigid or relatively inflexible structure, are known. In some cases, several single tools occupying respective tool places in the tool magazine in the punching machine are made for different extensive forming.

This causes either an enlargement of the tool magazine or increased set-up effort because the tools are to be exchanged again and again.

If another forming operation is to be performed, e.g. manufacturing another ribbing or gill, or another shape is embossed or different pinching contours are manufactured, furthermore, exchange of the tools causes an increase of the non-productive time and, thus, decelerates the workflow and renders the workflow uneconomic.

Thus, it is the object of the invention to provide a machining tool with which workflow can be optimized, whereby the usage of the tool magazine is improved and non-productive time is decreased.

SUMMARY

One aspect of the invention features a machining tool having a tool body with at least two tool elements, and a tool receiver in which the tool body is provided rotatably about a rotation axis, wherein the rotation axis is aligned in a direction which is different from a vertical direction, and wherein the tool body comprises at least two external surface portions arranged at different locations in a circumferential direction and at which the tool elements are fixable.

Another aspect of the invention features a sheet metal processing tool with a tool holder, and a tool body releasably held by the tool holder, and a machine controller adapted to rotate the tool holder about a rotation axis non-perpendicular to a surface to be machined. The tool body carries multiple tool elements at respective circumferential positions about the tool body, such that rotation of the tool holder to different rotational positions about the rotation axis presents different tool elements opposite the surface to be machined.

By providing at least two tool elements at one tool body, the tool body being rotatable about a rotation axis, the direction of which is different from a vertical direction (a direction in which the tool body contacts the workpiece), several different forming tool elements can be provided in only one tool. By the non-vertically rotatable support of the tool elements, the tool is not enlarged beyond its usual size. Except that, the forming tool elements can be changed by a simple rotation of the tool body without the necessity of exchanging the entire tool.

Now, the invention is elucidated on the basis of embodiments by means of the attached figures.

DETAILED DESCRIPTION

Figure 1:
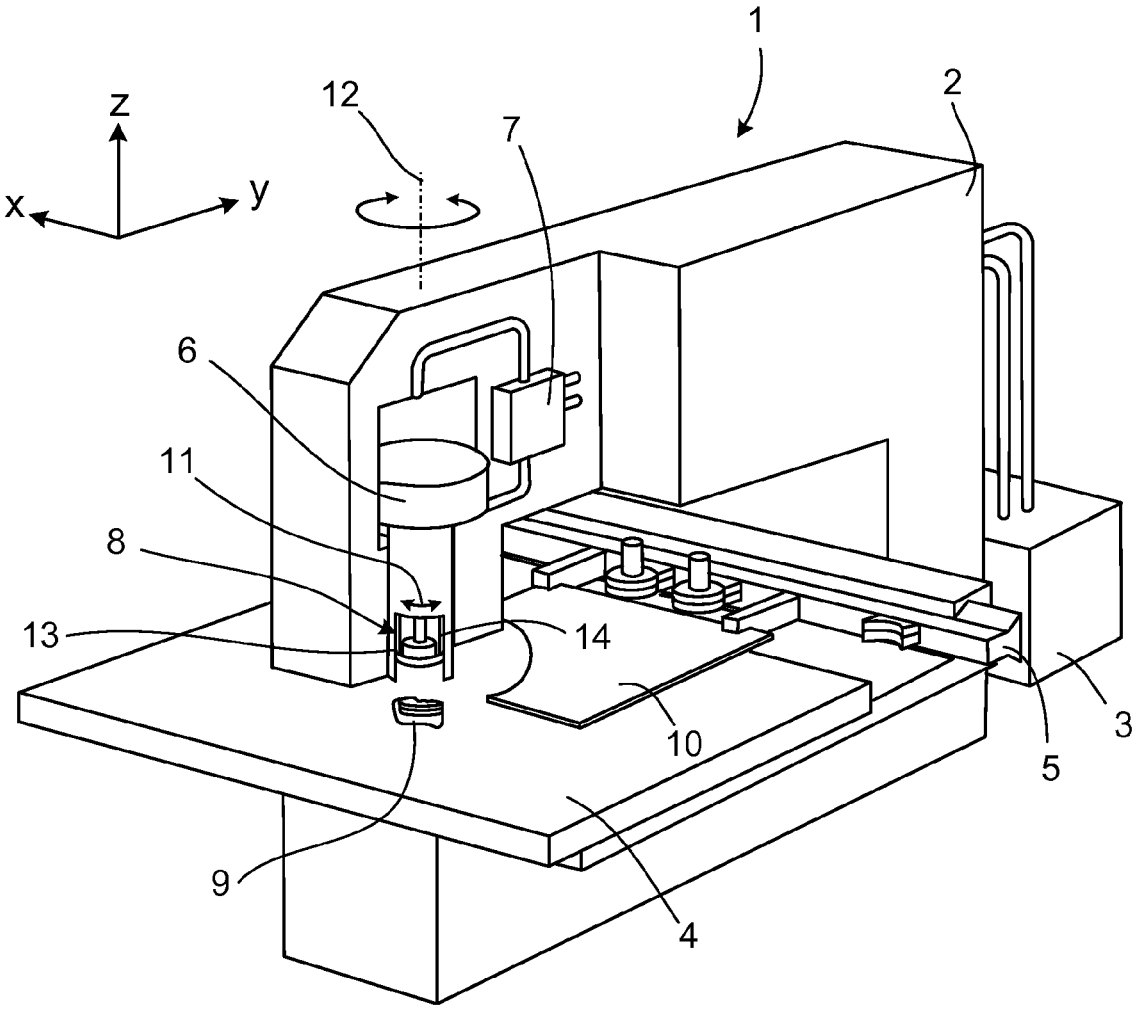
FIG. 1 shows a punching machine as an embodiment of a sheet metal processing machine.

FIG. 1 shows a punching machine 1 as an embodiment of a sheet metal processing machine. Another embodiment is, e.g., a combined punching and laser cutting machine.

The punching machine 1 comprises a C-frame 2. The C-frame 2 is made of a torsion-stiff welding construction of steel. At the back end of the C-frame 2, a hydraulic aggregate as power source for punching motions is arranged.

Furthermore, the punching machine 1 comprises a machine controller (not shown) connected to all of the actuators of the punching machine 1 and controlling the actuators.

On the lower inner side of the C-frame 2, a work piece sup-porting device 4 in the form of a machine table for placing the work piece is provided. Here, the work piece is a plate-shaped sheet metal 10, however, it also can be a plate of plastic or of another suitable material.

At the machine table, a work piece movement device 5 comprising, among others, a guide and a cross rail with clamping claws for gripping and moving the sheet metal 10 on the work piece supporting device 4.

At the front end of the upper shank of the C-frame 2, a plunger 6 with a plunger controller 7 is provided. By the plunger controller 7, the plunger 6 is controllable such that it can be stopped at any position in the range of its stroke in a Z-direction and, thus, any position in the Z-direction can be obtained.

In the plunger 6, an upper tool holder 8 for accommodating an upper part of a punching tool and of other tools, as e.g. forming tools, is provided.

At the front end of the lower shank of the C-frame 2, a lower tool holder 9 for accommodating a lower part of punching tools or of other tools, as e.g. forming tools, is provided.

In use, sheet metal 10 is positioned for a machining operation as the work piece movement device 5 displaces the gripped sheet metal 10 in an X-direction and in a Y-direction. Thereby, the sheet metal 10 slides on the machine table in the X-direction and it is displaced together with the machine table in the Y-direction. The machining operation, e.g. forming, is initiated after the positioning of the sheet metal 10 so that the patch of the sheet metal 10 to be worked is located at a defined place in the area of the forming tool. The plunger 6 moves downwardly about a predetermined maximum or another defined stroke and forms the sheet metal 10 in a requested manner. Then, the plunger 6 moves upwardly again into an upper position and the sheet metal 10 is repositioned for the next machining operation. Furthermore, the punching machine 1 comprises a drive 11 for the upper tool holder 8 with which the tool holder 8 can be rotated about a Z-Axis 12 of the plunger 6. Thereby, the upper tool holder 8 can be turned to any angle about the Z-axis 12 and can be fixed in this position.

A machining tool 13 with which the sheet metal 10 can be machined from above can be accommodated in the upper tool holder 8. For specific functions within the machining tool 13, a rotating drive 14 for the tool 13 is provided.

Figure 2:
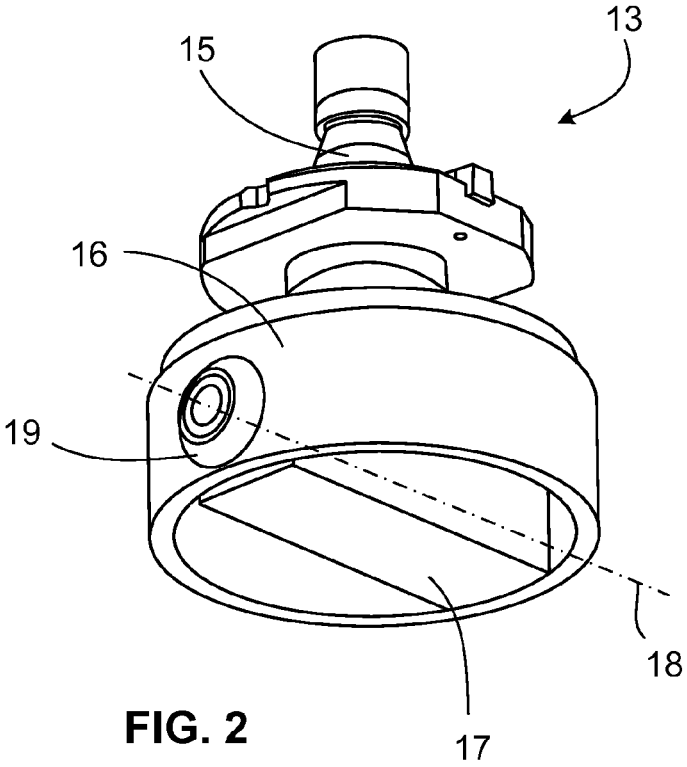
FIG. 2 shows a first embodiment of a machining tool.

FIG. 2 shows an embodiment of the machining tool 13 for machining the sheet metal 10. The machining tool 13 comprises a tool shaft 15 with which the tool 13 can be held in the upper tool holder 8 in a form-fit manner and without clearance.

Furthermore, the machining tool 13 comprises a tool receptacle 16 connected to the tool shaft 15. In the tool receptacle 16, a tool body 17 is supported rotatably about a rotation axis 18. In the first embodiment, the rotation axis 18 is horizontally arranged when the machining tool 13 is mounted in the punching machine 1. The tool body 17 is rotatable about the rotation axis 18 by means of a rotary wheel 19 as drive means. Optionally, latching means for locking the tool body 17 in the requested positions and, thereby, for preventing rotation, are provided.

Figure 3A:
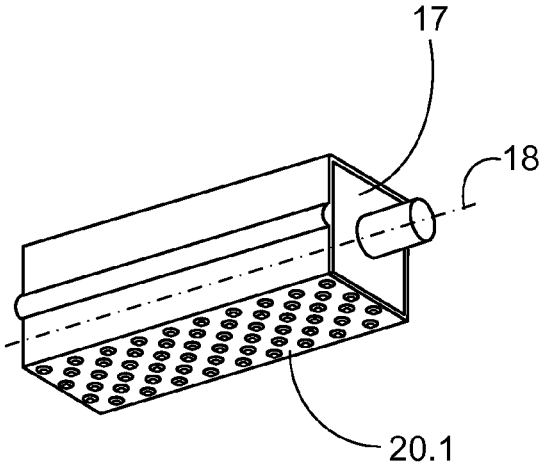
FIG. 3*a* shows a perspective view of a first embodiment of a receiving body with a first tool element integrated therein in a first orientation.
Figure 3B:
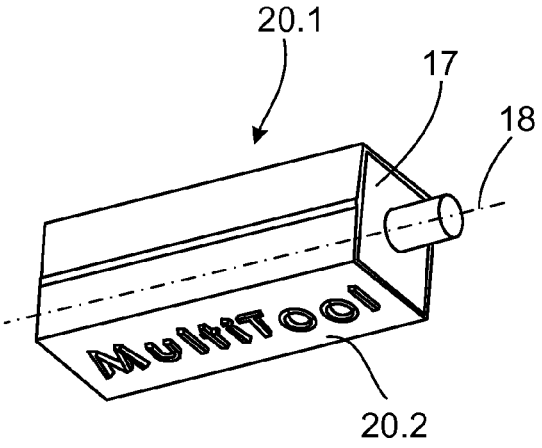
FIG. 3*b* shows a perspective view of the first embodiment of the receiving body with a second tool element integrated therein in a second orientation.

The tool body 17 is provided for accommodating tool elements 20 exemplarily shown in FIG. 3*a* and FIG. 3*b* and, in a first embodiment, integrated therein. The tool elements 20 are provided for machining the sheet metal 10 and they serve primarily for forming the sheet metal 10, in particular, for fabricating ribbings or gills or as embossing and pinching tools.

FIG. 3*a* and FIG. 3*b* show the tool body 17 in two different orientations. In FIG. 3*a*, in the shown orientation of the tool body 17, the tool element 20.1 is shown at the underside. The tool element 20.1 serves for embossing nob-like indentions.

In FIG. 3*b*, the tool body 17 is illustrated in a state rotated about 180 degrees about the rotation axis 18 so that, now, the tool element 20.1 is at the topside and the tool element 20.2 is arranged at the underside. The tool element 20.2 servers for embossing the expression "MultiTool".

The tool body 17 can be rotated by means of the rotary wheel 19 such that either the tool element 20.1 or the tool element 20.2 is located at the underside of the machining tool 13 which faces the sheet metal 10 to be machined.

The tool body 17 comprises exterior surface portions at which the tool elements 20 can be fixed at different locations in the circumferential direction, here at the topside and the underside. However, in alternative embodiments, the tool body 17 can be formed such that still more faces for fixing the tool elements 20 are provided so that, when viewed in the direction of the axis 18, a polygon results.

As shown in the first embodiment, the tool elements 20 can be integrated in the tool body 17 or they can be fixed by alternative mounting options.

One mounting option is the provision of threads in the tool body 17, wherein, the tool elements 20 then comprise bores by which they are fixed to the tool body 17 by means of bolts. An alternative embodiment is fixing the tool elements 20 by means of a magnet at the tool body 17. Alternatively or additionally, clamping devices by which the tool elements 20 are clamped at the tool body 17 are also possible.

Figure 4A:
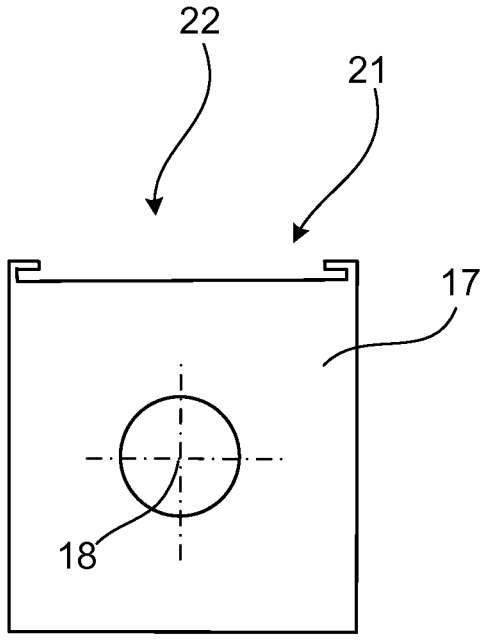
FIG. 4*a* shows a front view of a second embodiment of the receiving body with a receiving contour.
Figure 4B:
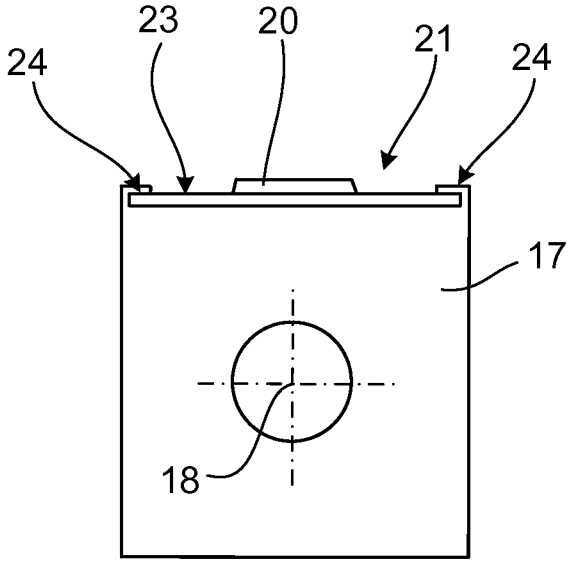
FIG. 4*b* shows a front view of the second embodiment of the receiving body with the receiving contour and with the tool element accommodated therein.

In an embodiment shown in FIG. 4*a* and FIG. 4*b*, the tool body 17 comprises a receiving contour 21 at one side. The receiving contour 21 is shown as cross section which is perpendicular with respect to the rotation axis 18 in FIGS. 4*a* and 4*b*. The receiving contour 21 is not closed and it forms an orifice 22 extending longitudinally along the rotation axis 18. The orifice 22 is directed to a radial exterior surface of the tool body 17. Webs directed to the orifice 22 and forming undercuts are formed laterally of the orifice 22 at the radial exterior surface of the tool body so that a T-groove is formed. The undercuts can alternatively be formed by other elements so that e.g. a dovetail results. In FIG. 4*a*, the receiving contour 21 is formed such that it comprises the undercuts in which the tool elements 20 can be inserted as shown in FIG. 4*b*. An outer contour 23 of the tool element 20 is formed such that it is complementary to the receiving contour 21 of the tool body 17. Due to the orifice 22, a portion of the inserted tool element 20 is exposed. The undercut 24 shown in FIG. 4*a* and FIG. 4*b* causes the outer contour 23 of the tool elements 20 and the receiving contour 21 of the tool body 17 to form a positive locking fixing the tool element 20.

In alternative embodiments, the outer contour 23 of the tool elements 20 is not necessarily complementary to the receiving contour 21, in particular, if the tool elements 20 are fixed by a fixing method as screwing on, a magnet or the like.

Figure 5:
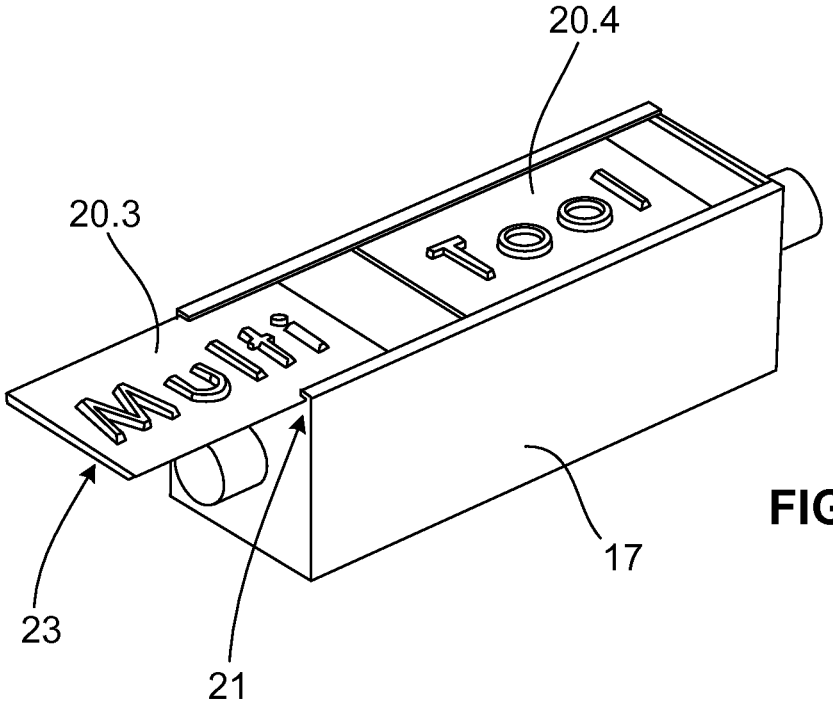
FIG. 5 shows a perspective view of the second embodiment of the receiving body with subdivided tool elements.

As shown in FIG. 5, the tool elements 20 must not necessarily consist of one single part but it can also be combined of several tool elements 20.3 and 20.4. In this embodiment, these tool elements 20.3 and 20.4 are inserted into the tool body 17 and fixed, wherein the outer contours of the tool elements 20 and the receiving contours 21 are also here complementary.

Figure 6A:
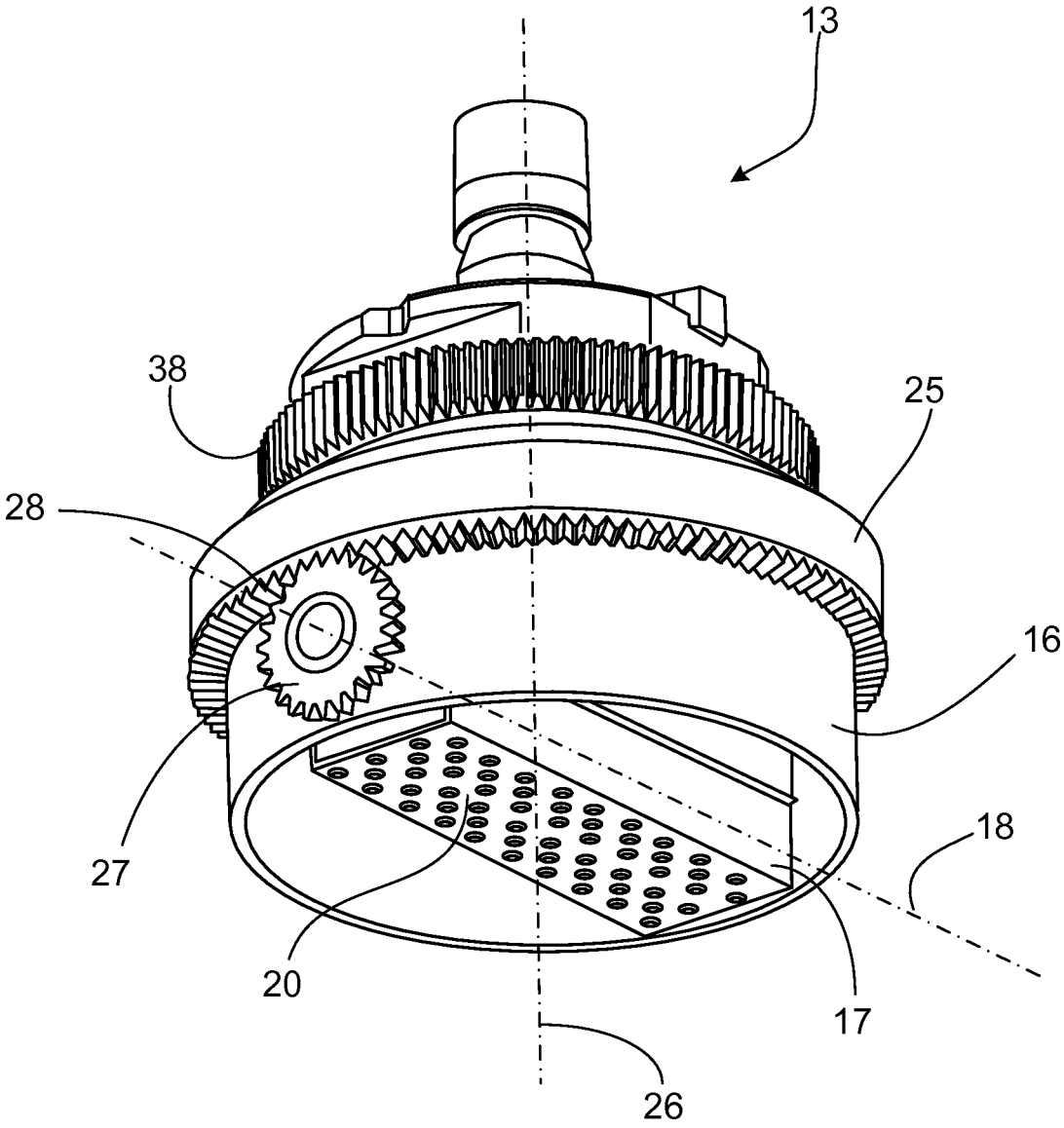
FIG. 6*a* shows a second embodiment of the machining tool.
Figure 6B:
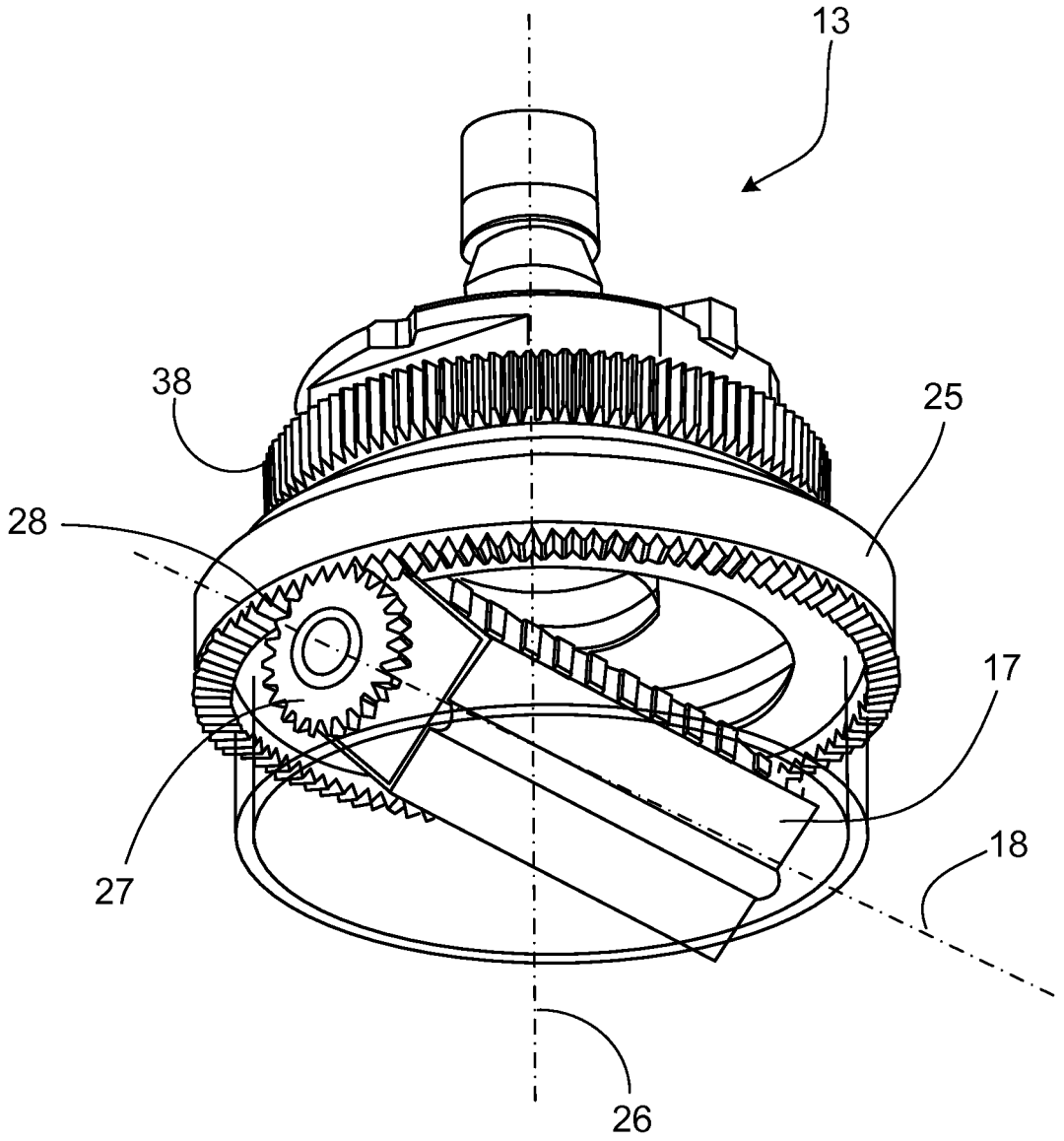
FIG. 6*b* shows the second embodiment of the machining tool during a change process of the used tool elements.

In the FIGS. 6*a* and 6*b*, a further embodiment of the machining tool 13 is shown. Additionally to the first embodiment, the second embodiment of the machining tool 13 comprises a toothed ring 25. The toothed ring 25 is rotatably provided at the machining tool 13 so that it can rotate about a rotation axis 26 of the machining tool. The toothed ring 25 comprises a first tooth profile 28 engaged with a bevel gear (gear wheel) 27 attached to the tool body 17. Rotating the toothed ring 25 about the rotation axis 26 causes the tool body 17 to rotate about its rotation axis 18.

The toothed ring 25 comprises a second tooth profile 38 en-gaged with the rotating drive 14 shown in FIG. 1. By rotating the rotating drive 14, the toothed ring 25 is rotated, whereby the tool body 17 is rotated (see FIG. 6*b*). Thus, the intended orientation of the tool body 17 about the Z-axis is achieved by a coordinated turning of the drive 11 rotating the upper tool holder 8 and, thus, the machining tool 13, and of the rotating drive 14 rotating the toothed ring 25. Thereby, the tool body 17 is rotated such that the requested tool element 20 is in a horizontal position at a side of the tool body 17 opposing the work piece to be machined.

Figure 7A:
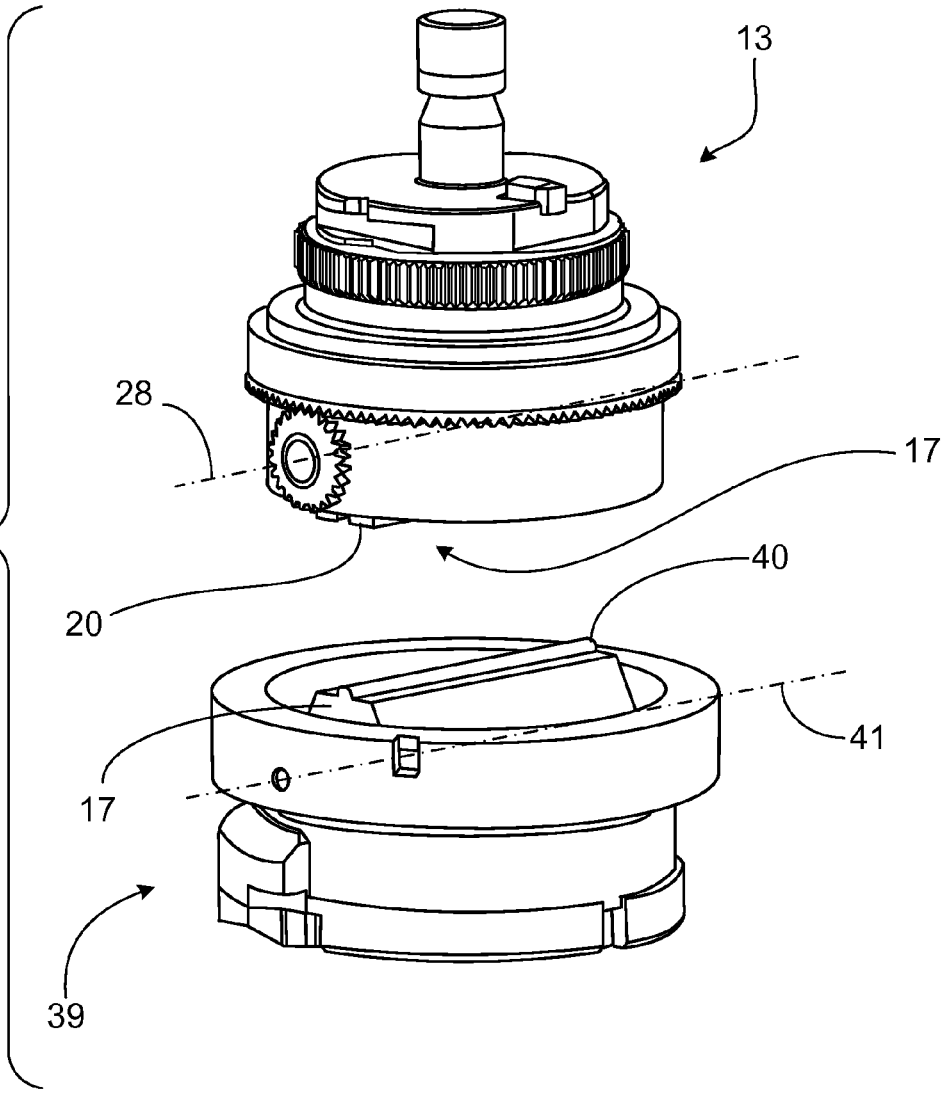
FIG. 7*a* shows a perspective view from obliquely above to the machining tool with a tool element for fabricating a ribbing and a complementary tool element in a corresponding counter tool.
Figure 7B:
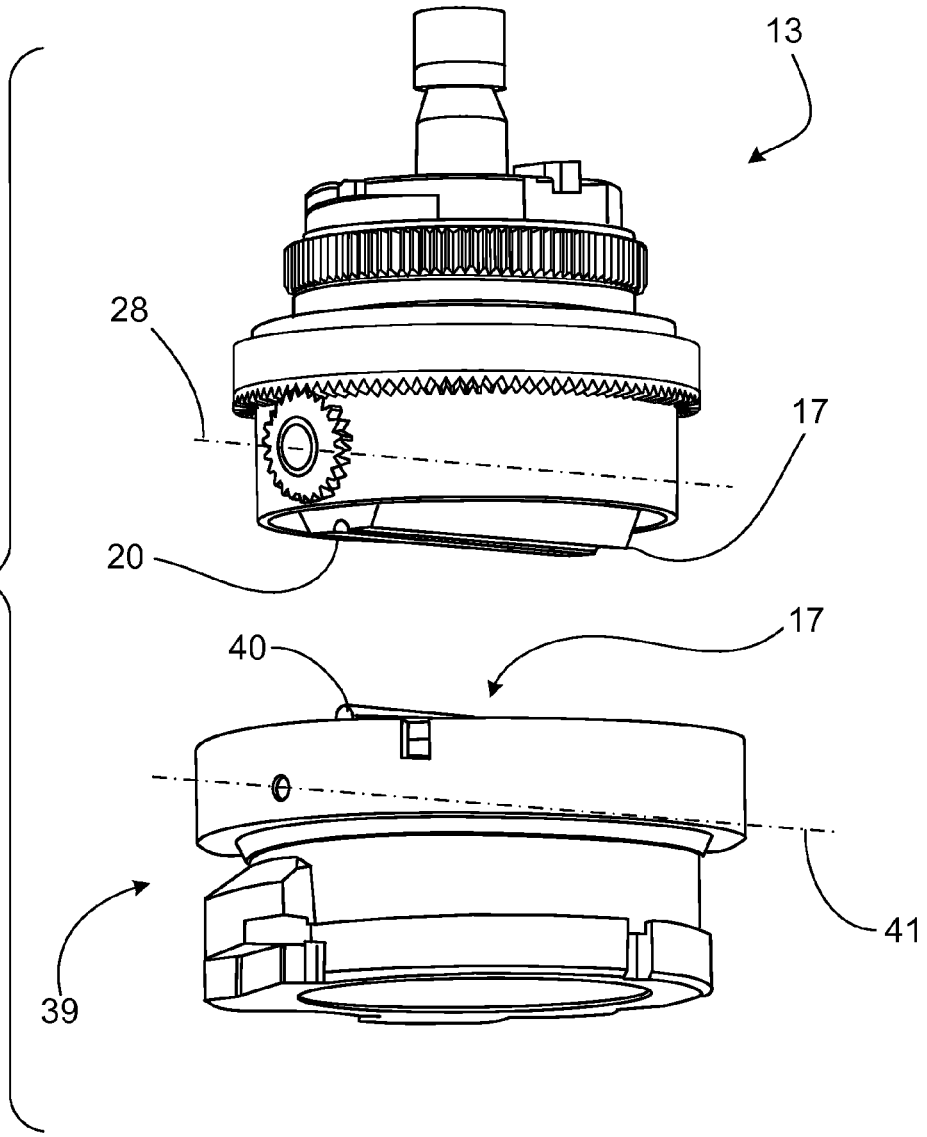
FIG. 7*b* shows a perspective view from obliquely below to the machining tool and the complementary tool element in the corresponding counter tool according to FIG. 7*a;*

The machining tool 13 according to the second embodiment shown in FIG. 7*a* and FIG. 7*b* is provided with tool elements 20 at the tool body 17, intended to deform the sheet metal in the form of ribbings. Alternatively, the machining tool 13 according to the first embodiment can be provided. Here, the machining tool 13 is formed such that it is intended to be accommodated in the upper tool holder 8.

Denoted with reference sign 39, a counter tool to a machining tool 13 is illustrated, wherein the counter tool 39 can be accommodated in the lower tool holder 9 of the machine (see FIG. 1). The counter tool 39 comprises a tool element 40 which is complementary to the tool element 20 of the machining tool 13. The tool body 17 of the counter tool is rotatable about an axis 41 of the counter tool 39. A rotating device conforms principally to that of the machining tool 13. As the rotation axis 18, the axis 41 is horizontally arranged in the mounted state.

Figure 8A:
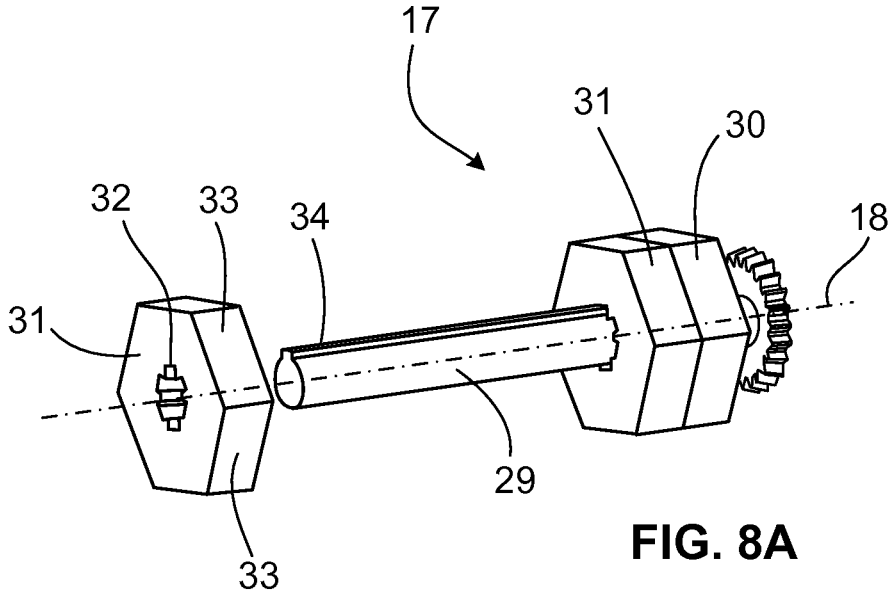
FIG. 8*a* shows a third embodiment of the receiving body with an embodiment of an axle.

In FIG. 8*a*, a third embodiment of the tool body 17 is shown. On one embodiment of an axle 29, a first disc 30 and one or several second disc(s) 31 form the receiving body 17. In contrast to the embodiments of the receiving body shown above, these discs 30, 31 have a hexagonal shape when viewed in direction of the axis 18. The disks 30 and 31 are arranged coaxially with respect to another and they each have a device by which the two discs 30, 31 are attachable on the axle 29 in a non-twistable manner with respect to each other. In the present case, the axle 29 comprises a tongue 34 and the discs 30, 31 comprise a center orifice 37 having several grooves 32. Therewith, a kind of groove and tongue connection is formed between the discs 30, 31 and the axle 29. The device can alternatively also be formed by an axle and a disk with an orifice complementary to the cross section of the axle, wherein the cross section of the axle is not circular.

Figure 8B:
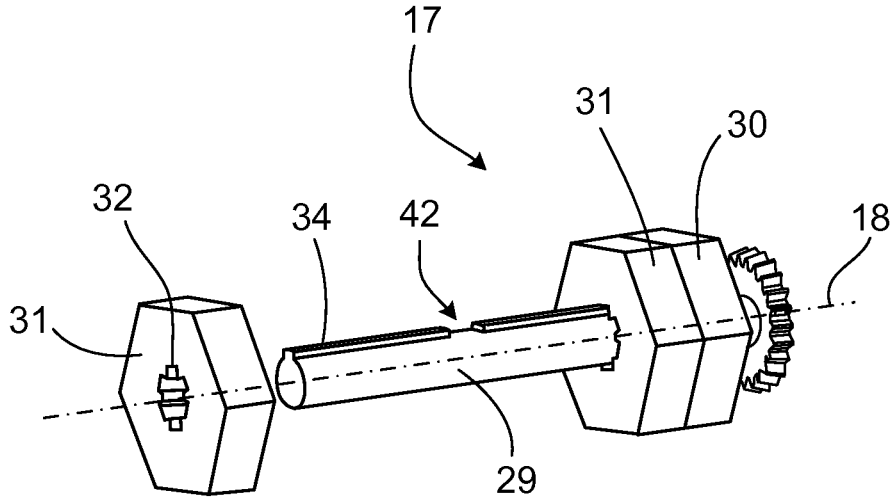
FIG. 8*b* shows the third embodiment of the receiving body with a further embodiment of the axle.

As shown in FIG. 8*b*, the first disc 30 and the second discs 31 are attached on a further embodiment of the axle 29. The difference between the two embodiments of the axle 29 is that the tongue 34 is interrupted along the axle 29 in the embodiment of FIG. 8*b*. A clearance 42 resulting from the interruption is at least as wide along the axle 29 as the width of one of the discs 30, 31. When the discs 30, 31 are shifted on the axle 29 such as to be located at the clearance 42, the discs 30, 31 can be twisted with respect to the axle 29 without entirely removing the discs 30, 31 from the axle 29. Alternatively, several clearances 42 can be provided. Then, these clearances are arranged such that the discs 30, 31 are not located at the clearances 42 in their inserted working position so that they do not twist.

Such an arrangement where the number of the grooves 32 corresponds to the number of the side faces 33 can also be performed such that not six side faces as illustrated exist but ten side faces 33 exist. Thereby, on each of the side faces 33 of a disc 30, 31, a tool element 20 having a digit from 0 to 9 can be fixed so that a consecutive numbering for marking a batch or the like can be embossed. Here, the grooves 32 are complementary to a tongue 34 on the axle 29 and the discs 30, 31 can be attached respectively in a twisted manner such that even side faces along the axis 18 respectively result.

Figure 9:
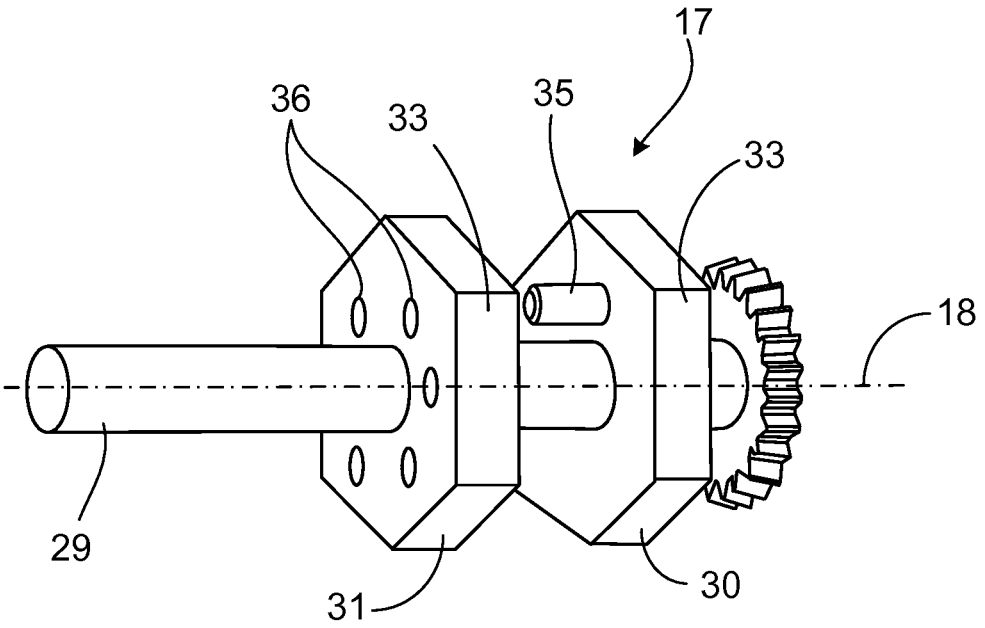
FIG. 9 shows a fourth embodiment of the receiving body.
Figure 10A:
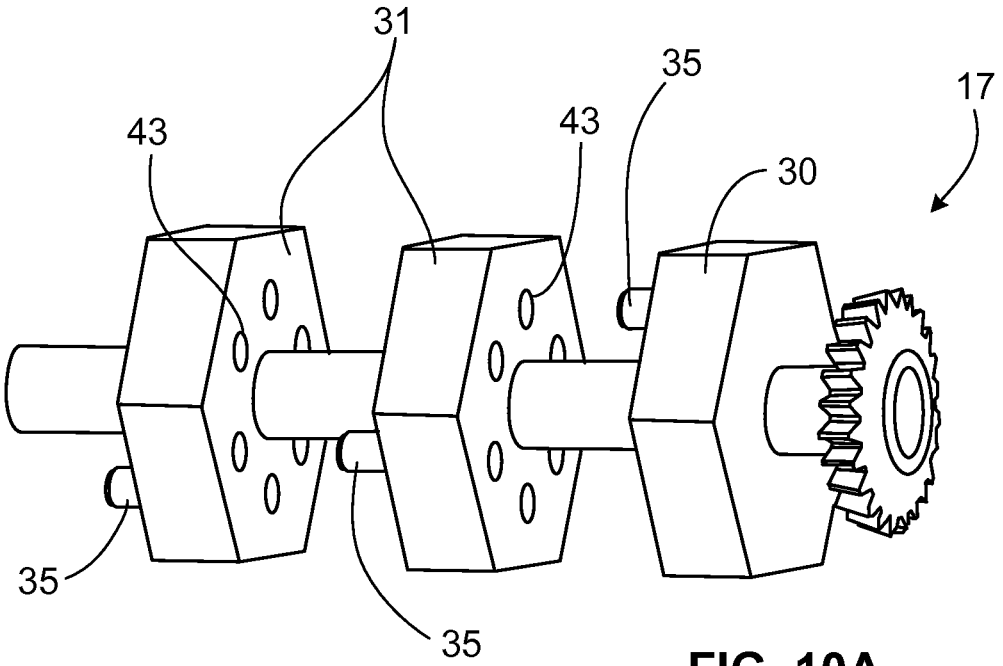
FIGS. 10*a* and 10*b* show a fifth embodiment of the receiving body.
Figure 10B:
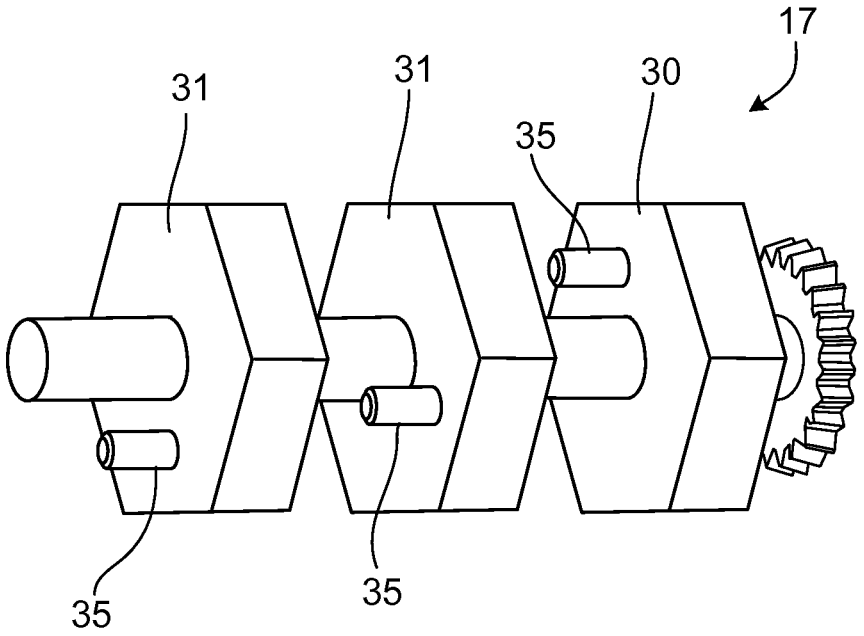

A fourth and fifth embodiment of the tool body is shown in FIG. 9 and in FIGS. 10*a* and 10*b*. This embodiment essentially conforms to the embodiment shown in FIGS. 8*a* and 8*b* in which several side faces 33 can be strung together in different combinations. In this embodiment, the first disc 30 is connected to the axle 29 so that it cannot be twisted thereto. The disc 30 and the disc 31 include a device by which the two discs 30, 31 are attachable in a non-twistable manner with respect to each other. The disc 30 comprises a protruding shaped piece 35, here in the form of a pin. As shown in FIG. 9, in a side face, the second disc 31 defines several through orifices 36 (fourth embodiment) complementary to the protruding shaped piece 35. Alternatively, as shown in FIGS. 10*a* and 10*b*, in one of the side faces of the disc 31 opposite to the protruding shaped piece 35, the disc 31 defines indentions 43 which do not completely penetrate the discs 31 (fifth embodiment).

In the embodiment shown in FIG. 9, by a shaped piece 35 (pin), several discs 31 may be non-twistable with respect to another and with respect to the disc 30. In an alternative to the embodiment shown in FIGS. 10*a* and 10*b*, the shaped pieces and indentions 43 can also be arranged at the outer circumference.

The number of the complementary orifices 36 conforms in turn to the number of the side faces and the protruding shaped piece and the complementary orifices 36 are respectively arranged such that the side faces 33 are aligned to form an even face. The second and the further discs 31 are twistable about the axle 29.

The advantage also of this embodiment is that the discs 31 need not be completely disassembled from the axle 29 for twisting the discs 31 with respect to another. Here, the disc 31 with the orifices 36 has only to be shifted about the length of the protruding shaped piece 35 until the shaped piece 35 is no longer engaged with the orifice 36. Then, the disc 31 can be twisted with respect to the disc 30 and, then the shaped piece 35 can be engaged again with one of the orifices 36, whereby, the side faces 3 again form an even face. In the case of shaped pieces 35 (pins) which are too long, the advantage that the discs need not be completely disassembled for twisting is dropped.

Figure 11:
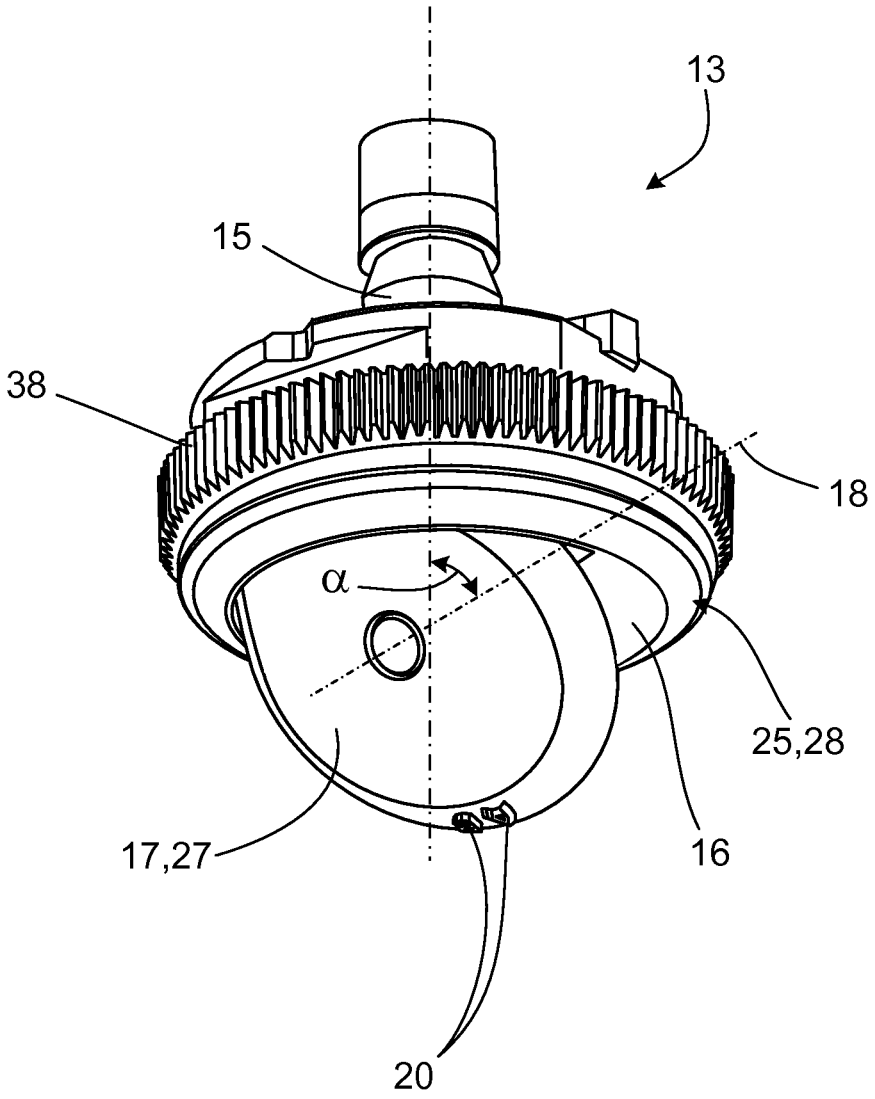
FIG. 11 shows a third embodiment of the machining tool with a sixth embodiment of the receiving body.

FIG. 11 shows a third embodiment of the machining tool 13 with a sixth embodiment of the tool body 17.

Also here, the machining tool 13 includes the tool shaft 15 for accommodating the machining tool 13 in one of the tool holders 8, 9, and the tool receptacle 16. Other options for accommodating are possible. In contrast to the preceding embodiments of the machining tools 13, in the tool receptacle 16 of this embodiment, the tool body 17 is supported rotatably such that it is rotatable about the rotation axis 18 which is not horizontal and the direction of which also does not conform to a horizontal direction. The direction of the rotation axis has an angle $\alpha$ with respect to a vertical direction which is larger than 0 degree and smaller than 90 degrees.

Compared to the preceding embodiments of the tool body 17, the dimensions of the diameter of the tool body 17 and the dimension in the direction of the rotation axis 18 are such that, here, the diameter is relatively large and the dimension in direction of the rotation axis 18 is relatively small. Thus, a disc-like tool body 17 results.

Due to the relatively large diameter, a great number of tool elements 20 can be fixed on the circumference of the tool body 17. However, a large diameter means that, if the rotation axis is, e.g., horizontally or vertically aligned, the dimensions of the machining tool 13 are also to be enlarged in order to accommodate the tool body 17. Thus, by the alignment of the rotation axis 18 at an angle which is larger than 0 degree and smaller than 90 degrees with respect to the vertical direction, the possibility to fix a larger number of tool elements 20 at the tool body 17 without essentially enlarging the machining tool results. In this embodiment, the angle is 45 degrees, wherein other angles are alternatively possible.

As in one of the preceding embodiments, the tool body 17 comprises the bevel gear (gear wheel) 27 as drive device engaged with the tooth profile 28 of the toothed ring 25. Alternatively, a rotary wheel 19 is possible for rotating the tool body 17.

Also here, the toothed ring 25 comprises the second tooth profile 38 engaging with the rotating drive 14 shown in FIG.

1. By rotating the rotating drive 14, the toothed ring 25 is rotated, whereby the tool body 17 is then also here rotated. The requested orientation of the tool body 17 about the Z-axis is therefore achieved by a coordinated twisting of the drive 11 rotating the upper tool holder 8 and, therefore, the machining tool 13, and of the rotating drive 14 rotating the toothed ring 25. Thereby, the tool body 17 is rotated such that the requested tool element 20 is located in a horizontal position at a portion of the tool body 17 opposite to the work piece to be machined.

Optionally, there is an option that, comparable to the embodiments shown in FIGS. 8 to 10, the tool body consists of several discs which can be coupled to another.

The two tool elements 20 are integrated in the tool body 17. Alternatively, the tool elements 20 can be accommodated in an above-described receiving contour. Then, the tool elements 20 also have an exposed portion along the rotation axis 18. Alternatively, the entire circumference of the tool body 17 can be provided with a plurality of tool elements 20. Optionally, the tool elements 20 have an outer contour which is complementary to the receiving contour, whereby, if necessary, an undercut of the receiving contour in direction of the radial external face of the tool body 17 forms a positive locking with the tool elements 20. As described above, the tool elements 20 can be fixed to the tool body 17 in different manners.

Also in this shown embodiment, the tools are forming tools. Alternatively, pinching tools can be provided. Then, into the tool holder 8, 9 opposite to the tool holder 8, 9 in which the machining tool 13 is accommodated, a counter tool optionally also comprising twistable counter tool elements is accommodated.

Figure 12A:
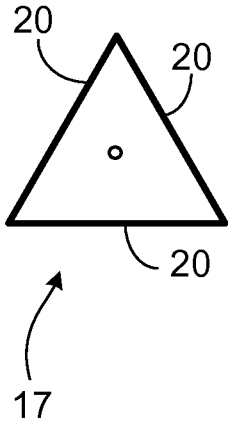
FIG. 12 shows further embodiments of the receiving body with different cross sections.
Figure 12B:
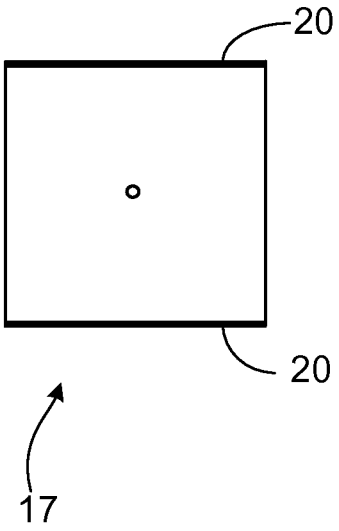
Figure 12C:
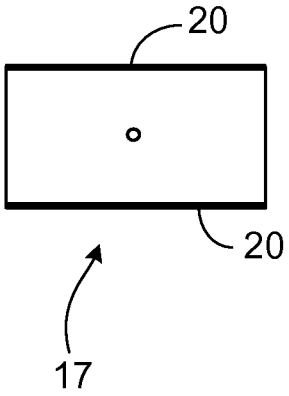

In FIG. 12, further embodiments of the tool body 17 are illustrated. Triangular cross sections (a), square cross sections with tool elements 20 at all of the sides (b) (in contrast to the embodiments shown in the FIGS. 3 to 6 comprising merely two opposite tool elements 20) or also rectangular (not square) cross sections can alternatively be used. The tool elements 20 are provided at the wide side faces (or alternatively at the narrow side faces).

In use, the machining tool 13 is received from a tool magazine in the upper tool holder 8 in a known manner. In alternative embodiments, the tool can also be accommodated in the lower tool holder 9, however, the lower tool holder 9 has to be equipped with appropriate drives 11, 14 conforming to such an upper tool holder 8.

Subsequently, the sheet metal 10 is shifted under the upper tool holder 8 such that the requested area of the sheet metal 10 to be formed is located underneath the tool 13. Then, the upper tool holder 8 with the machining tool 13 is rotated by means of the drive 11 such that the machining tool 13 has the requested alignment with respect to the sheet metal 10. Simultaneously or chronologically shifted, the rotating drive 14 rotates the toothed ring 25 about a predetermined angle so that, coordinated with the rotation of the machining tool 13, the requested tool element 20 is arranged at the underside of the tool body 17, therefore being opposite to the work piece to be machined. Subsequently, a stroke of the plunger 6 initiated by the plunger controller 7 is performed so that the requested forming operation of the sheet metal 10 is executed. Subsequently, the plunger 6 with the machining tool 13 moves upwards again and the sheet metal 10 is appropriately shifted so that the next area can be machined. The context, therefore the coordination, of the rotation angle of the machining tool 13 about the Z-axis 12 of the plunger 6 and of a rotation angle performed by the rotating drive 14 in order to arranged the requested tool element 20 at the underside of the tool body 17 is stored in the machine controller or it is calculated by the machine controller.

In the first embodiment of the machining tool 13, the orientation of the receiving body 17 is carried out by manual rotation at the rotary wheel 19. In order to avoid an undesired rotation, a latching device can be provided.

The invention claimed is:

1. A machining tool, comprising:

a tool body for carrying at least two tool elements, a tool receptacle in which the tool body is mounted for rotation about a rotation axis, and a tool shaft configured to be received in a tool holder for mounting the machining tool in a machine, wherein the rotation axis is perpendicular to the tool shaft and extends along a direction different from a direction in which the machining tool is configured to contact a workpiece in use, and wherein the tool body comprises at least two external surface portions arranged at different locations in a circumferential direction and configured to present respective tool elements for workpiece processing with the tool body rotated to selective rotational positions about the rotation axis.

2. The machining tool of claim 1, further comprising a drive device coupled to the tool body.

3. The machining tool of claim 2, wherein the drive device comprises a first tooth profile, and wherein the tool body comprises a tooth profile engaging the first tooth profile.

4. The machining tool of claim 3, wherein the drive device comprises a second tooth profile configured to be coupled to a rotating drive of an external drive device.

5. The machining tool of claim 1, wherein the tool body comprises multiple discs arranged axially with respect to another with side faces each adapted to carry respective tool elements, and wherein the discs comprise at least one coupling by which two adjacent discs are selectively coupled together in a non-twistable manner.

6. The machining tool of claim 1, wherein the tool elements are integral with the tool body, such that the tool body itself forms the tool elements.

7. The machining tool of claim 1, wherein the tool body comprises at least one receiving contour for receiving removable tool elements and holding the tool elements on the tool body such that the tool elements are each exposed at respective circumferential positions about the rotation axis.

8. The machining tool of claim 7, wherein the removable tool elements have an external contour formed in a complementary manner with respect to the receiving contour of the tool body.

9. The machining tool of claim 7, wherein the receiving contour defines an undercut, such that the external contour of the tool elements and the receiving contour cooperate to form a positive locking in a direction toward a radial external face of the machining tool.

10. The machining tool of claim 7, wherein the tool body comprises a clamping mechanism configured to claim at least one of the tool elements in place.

11. The machining tool of claim 7, wherein the tool body comprises threads, and wherein the tool elements define orifices for receiving threaded fasteners for fixing the tool elements to the tool body.

12. The machining tool of claim 1, wherein the machining tool is configured as a forming tool or a pinching tool.

13. A sheet metal processing machine comprising:

a tool holder;

a tool body releasably held by the tool holder; and a machine controller adapted to rotate the tool body about a rotation axis non-perpendicular to a surface to be machined;

wherein the tool body carries multiple tool elements at respective circumferential positions about the tool body, such that rotation of the tool body to different rotational positions about the rotation axis presents different tool elements opposite the surface to be machined, and wherein the tool body comprises a tool shaft rotatable within the tool holder, and wherein the tool holder and tool body comprise mating tooth profiles, such that rotation of the tooth profile of the tool holder rotates the tooth profile of the tool body, effecting rotation of the tool body about the rotation axis.

14. A machining tool, comprising:

a tool body for carrying at least two tool elements, and a tool receptacle in which the tool body is mounted for rotation about a rotation axis, wherein the rotation axis extends along a direction different from a direction in which the machining tool is configured to contact a workpiece in use, wherein the tool body comprises at least two external surface portions arranged at different locations in a circumferential direction and configured to present respective tool elements for workpiece processing with the tool body rotated to selective rotational positions about the rotation axis, wherein the tool body comprises multiple discs arranged axially with respect to another with side faces each adapted to carry respective tool elements, and wherein the discs comprise at least one coupling by which two adjacent discs are selectively coupled together in a non-twistable manner.

15. A machining tool, comprising:

a tool body for carrying at least two tool elements, a tool receptacle in which the tool body is mounted for rotation about a rotation axis, and a tool shaft configured to be received in a tool holder for mounting the machining tool in a machine, wherein the rotation axis extends along a direction different from a direction in which the machining tool is configured to contact a workpiece in use, wherein the tool body comprises at least two external surface portions arranged at different locations in a circumferential direction and configured to present respective tool elements for workpiece processing with the tool body rotated to selective rotational positions about the rotation axis, and wherein the rotation axis forms an angle with the tool shaft, the angle being larger than 0 degrees and smaller than 90 degrees.

16. A machining tool, comprising:

a tool body for carrying at least two tool elements, and a tool receptacle in which the tool body is mounted for rotation about a rotation axis, wherein the rotation axis extends along a direction different from a direction in which the machining tool is configured to contact a workpiece in use, wherein the tool body comprises at least two external surface portions arranged at different locations in a circumferential direction and configured to present respective tool elements for workpiece processing with the tool body rotated to selective rotational positions about the rotation axis, wherein the tool body comprises at least one receiving contour for receiving removable tool elements and holding the tool elements on the tool body such that the tool elements are each exposed at respective circumferential positions about the rotation axis, and wherein the receiving contour defines an undercut, such that the external contour of the tool elements and the receiving contour cooperate to form a positive locking in a direction toward a radial external face of the machining tool.

17. A machining tool, comprising:

a tool body for carrying at least two tool elements, and a tool receptacle in which the tool body is mounted for rotation about a rotation axis, wherein the rotation axis extends along a direction different from a direction in which the machining tool is configured to contact a workpiece in use, wherein the tool body comprises at least two external surface portions arranged at different locations in a circumferential direction and configured to present respective tool elements for workpiece processing with the tool body rotated to selective rotational positions about the rotation axis, wherein the tool body comprises at least one receiving contour for receiving removable tool elements and holding the tool elements on the tool body such that the tool elements are each exposed at respective circumferential positions about the rotation axis, and wherein the tool body comprises a clamping mechanism configured to claim at least one of the tool elements in place.

* * * * *